US009208681B2

(12) United States Patent
Borton et al.

(10) Patent No.: US 9,208,681 B2
(45) Date of Patent: Dec. 8, 2015

(54) VEHICLE WHEEL AND AXLE SENSING METHOD AND SYSTEM

(71) Applicant: Xerox Corporation, Norwalk, CT (US)

(72) Inventors: Michael D. Borton, Ontario, NY (US); Abu S. Islam, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 100 days.

(21) Appl. No.: 14/227,286

(22) Filed: Mar. 27, 2014

(65) Prior Publication Data

US 2015/0279209 A1 Oct. 1, 2015

(51) Int. Cl.

| | |
|---|---|
| ***G06M 7/00*** | (2006.01) |
| ***G06M 9/00*** | (2006.01) |
| ***G06M 11/00*** | (2006.01) |
| ***G08G 1/01*** | (2006.01) |

(52) U.S. Cl.
CPC ..... *G08G 1/01* (2013.01)

(58) Field of Classification Search
USPC ..... 377/6, 9; 340/933
See application file for complete search history.

(56) References Cited

U.S. PATENT DOCUMENTS

| | | | | |
|---|---|---|---|---|
| 3,045,909 | A * | 7/1962 | Auer, Jr. | G08G 1/015 235/99 A |
| 3,748,443 | A * | 7/1973 | Kroll | G08G 1/015 200/86 R |
| 4,258,430 | A * | 3/1981 | Tyburski | G08G 1/0104 377/9 |
| 5,629,509 | A | 5/1997 | Uebel | |
| 5,821,879 | A | 10/1998 | Liepmann | |
| 8,359,147 | B2 | 1/2013 | Gowan et al. | |
| 8,493,238 | B2 | 7/2013 | Nagy | |
| 8,528,393 | B2 | 9/2013 | Craig et al. | |
| 2002/0018007 | A1 * | 2/2002 | Hilliard | E01F 11/00 340/941 |
| 2003/0201909 | A1 * | 10/2003 | Hilliard | G08G 1/02 340/940 |
| 2007/0120707 | A1 * | 5/2007 | Donnelly | B60Q 9/002 340/933 |
| 2011/0080307 | A1 * | 4/2011 | Nagy | G06Q 30/0283 340/937 |
| 2011/0119013 | A1 | 5/2011 | Onea et al. | |
| 2013/0015002 | A1 | 1/2013 | Sasser | |
| 2015/0124924 | A1 * | 5/2015 | Moore | H01L 41/00 377/9 |

FOREIGN PATENT DOCUMENTS

| | | | |
|---|---|---|---|
| EP | 0 976 638 | A1 | 2/2000 |
| EP | 1 908 621 | A1 | 4/2008 |
| EP | 1 582 382 | B1 | 10/2013 |

* cited by examiner

*Primary Examiner* — Adam Houston
(74) *Attorney, Agent, or Firm* — Kermit D. Lopez; Luis M. Ortiz; Ortiz & Lopez, PLLC

(57) ABSTRACT

Methods and systems for counting vehicle wheels and axles. A strip material can be embedded in a roadway to produce a slightly raised surface. The strip can be angled at a relatively large angle, (e.g., 78 degrees) with respect to the direction of travel. The number of wheels per axle and the number of axles per vehicle can be counted as the vehicle rolls over the strip and the wheels contact the strip at different times. A signal emitted from a detection mechanism(s) associated with the strip material can be transmitted to a signal processing unit to determine the number of wheels and axle with respect to the vehicle. The vehicle wheel and axle counts can be determined by the number and grouping of signals from the detection mechanism. Such an approach provides a reliable, direct measure of the wheel and axle counts for toll charge or classification purposes.

20 Claims, 6 Drawing Sheets

VEHICLE WHEEL AND AXLE SENSING METHOD AND SYSTEM

FIELD OF THE INVENTION

Embodiments are generally related to the field of vehicle detection. Embodiments also relate to vehicle wheel and axle counting techniques. Embodiments also relate to the field of toll roads used in vehicle transportation.

BACKGROUND

In transportation systems, it is desirable to count the number of wheels and axles with respect to a vehicle for classification purposes. Conventional sensing approaches utilize a mechanical treadle device or an inductive loop buried in a pavement along with signal processing to estimate these entities. The treadles are mechanical devices and as such subject to wear, degradation by environment and other issues and requires high maintenance. An inductive loop counting method is indirect and only infers results based on averages. Hence, slight differences in vehicle design and construction may result in supplying erroneous counts. Neither of these techniques can count the number of wheels, only the number of axles. Also, human classifiers are often required to avoid inaccurate counts.

Based on the foregoing, it is believed that a need exists for an improved approach for counting a vehicle wheel and axle, as described in greater detail herein.

SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for improved vehicle sensing methods and systems.

It is another aspect of the disclosed embodiment to provide for improved vehicle wheel and axle monitoring methods and systems.

The aforementioned aspects and other objectives and advantages can now be achieved as described herein. Methods and systems for counting vehicle wheels and axles are disclosed herein. A strip material can be attached to or embedded in a roadway to produce a slightly raised surface. The strip can be angled at a relatively large angle (e.g., approximately 78 degrees) with respect to the direction of travel. The number of wheels per axle and/or the number of axles per vehicle can be counted as the vehicle rolls over the strip material and the wheels contact the strip material at different times or intervals. A signal emitted from one or more detection mechanisms associated with the strip material can be transmitted to a signal processing unit to determine the number of wheels and axles with respect to the vehicle. The vehicle wheel and axle counts can be determined according to the number and groupings of signals. Such an approach can provide a reliable and direct measurement of the wheel and axle count for a toll charge purpose.

The strip material can also be attached to the roadway. The contact between the wheels and strip can be detected by a microphone which can pick up sound with respect to the wheels hitting the strip. The microphone can be of a directional type located at the roadside making installation and maintenance convenient and easy. A vibration transducer placed in the pavement in close proximity to the strip can also be utilized to detect the wheel and axle. A pressure transducer can be attached to a tube if the strip is made of hose or tubing. The wheels contacting the tube can result in an increase in pressure and fluctuations which is similar to an audible signal. A gross weight of the vehicle can be estimated based on magnitude of fluctuations in pressure. The system counts both axles and wheels of the vehicle for use in tolling applications if critical system design parameters are optimized.

BRIEF DESCRIPTION OF THE FIGURES

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

Figure 1:
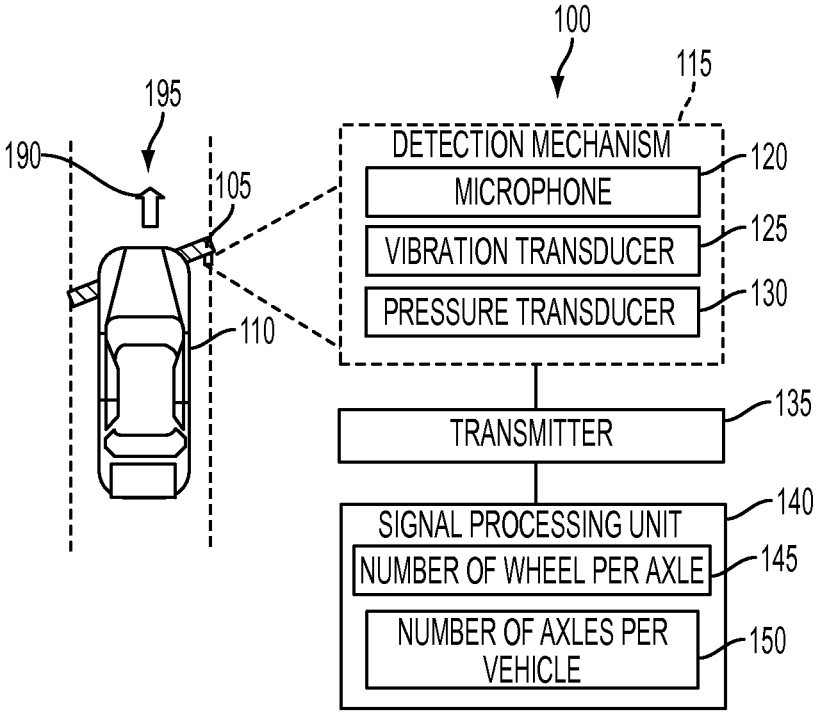
FIG. 1 illustrates a block diagram of a vehicle wheel and axle monitoring system, in accordance with the disclosed embodiments.

FIG. 1 illustrates a block diagram of a vehicle wheel and axle monitoring system 100, in accordance with the disclosed embodiments. Note that in FIGS. 1-10, identical or similar parts or elements are generally indicated by identical reference numeral. The vehicle wheel and axle monitoring system 100 can be employed to monitor and count a number of wheels per axle 145, and a number of axles per vehicle 150 associated with a vehicle 110 such as, for example, trucks, trailers, buses, automobiles, motorized recreational vehicles, recreational trailers, cube vans, vans, mini-vans, and the like. The system 100 generally includes a strip material 105, a detection mechanism 115, a transmitter 135, and a signal processing unit 140.

The detection mechanism 115 can communicate electronically with the transmitter 135 and/or the signal processing unit 140. Such communication may occur directly (e.g., wired, direct electrical communication) or indirectly via wireless communications (e.g., WiFi, cellular, Bluetooth, etc.). Examples of detection mechanisms for use as detection mechanism 115 are shown in FIG. 1. Detection mechanism 115 can be provided as, for example, a microphone 120, a vibration transducer 125, a pressure transducer 130 or a combination thereof. It should be appreciated, however, that the detection mechanism 115 is not limited to any such devices 120, 125, 130, but may be implemented in the context of other detecting devices or components. Devices 120, 125, and/or 130 can be implemented in the context of a preferred example embodiment. Other devices not described herein, however, can be implemented in other example embodiments.

The strip material 105 can be embedded in a roadway 195 to produce a slightly raised surface. The strip material 105 can also be attached to the roadway 195. The strip material 105 can be angled at a relatively large angle with respect to a direction of travel 190. For example, the strip material 105 can be angled 78 degrees with respect to the direction of travel 190. The strip material 105 in association with the detection mechanism 115 counts the number of wheels per axle 145 and the number of axles per vehicle 150 as the vehicle 110 rolls over the strip material 105 and the wheels 145 contact the strip material 105 at different times.

The detection mechanism 115 transmits signals to the signal processing unit 140. In general, the transmitter 135 is an electronic device which, with an aid of an antenna, produces radio waves. The transmitter 135 itself generates a radio frequency alternating current, which can be applied to the antenna. The vehicle wheel and axle counts 145 and 150 can be determined by a number and grouping of signals from the detection mechanism 115. Note that the detection mechanism 115 can be, for example, a microphone 120, a vibration transducer 125, or a pressure transducer 130, depending upon design consideration.

Figure 2:
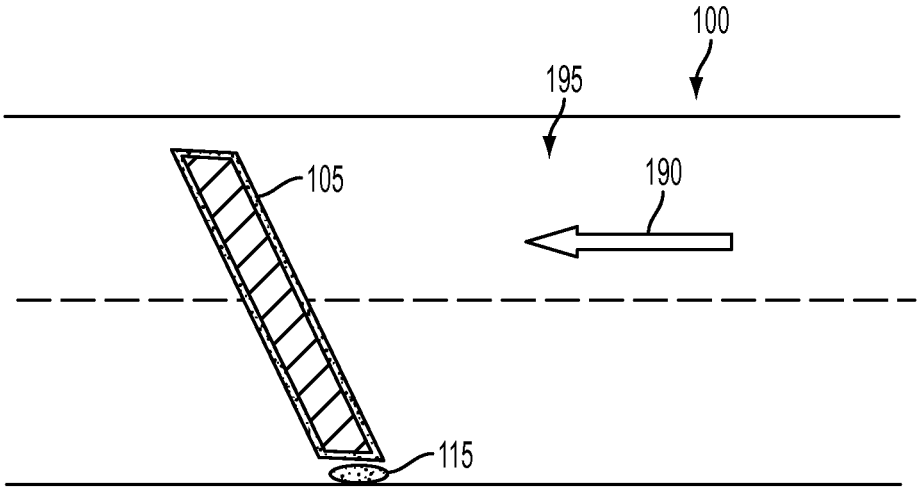
FIG. 2 illustrates a schematic view of the vehicle wheel and axle monitoring system, in accordance with the disclosed embodiments.

FIG. 2 illustrates a schematic view of the vehicle wheel and axle monitoring system 100, in accordance with the disclosed embodiments. The vehicle wheel and axle monitoring system 100 senses wheel crossing utilizing the strip material 105 and the detection mechanism 115 placed appropriately to enable counting the number of wheels and axles 145 and 150 for toll charge or classification purposes. The microphone 120 detects contact between the wheels 145 and the strip material 105 and pick up sound with respect to the wheels 145 hitting the strip material 105. The microphone 120 can be of a directional type located at the roadside 195 making installation and maintenance convenient and easy.

The vibration transducer 125 can be placed in a pavement in close proximity to or in contact with the strip material 105 to detect the wheel and axle 145 and 150. The pressure transducer 130 can be attached to a tube if the strip material 105 is made of hose or tubing. The wheels 145 contacting the tube can result in an increase in pressure and fluctuations which is similar to an audible signal. A gross weight of the vehicle 110 can be estimated based on the magnitude of fluctuations in pressure. The system 100 counts both axles and wheels 150 and 145 of the vehicle 110 for use in tolling applications if critical system design parameters are optimized.

Figure 3:
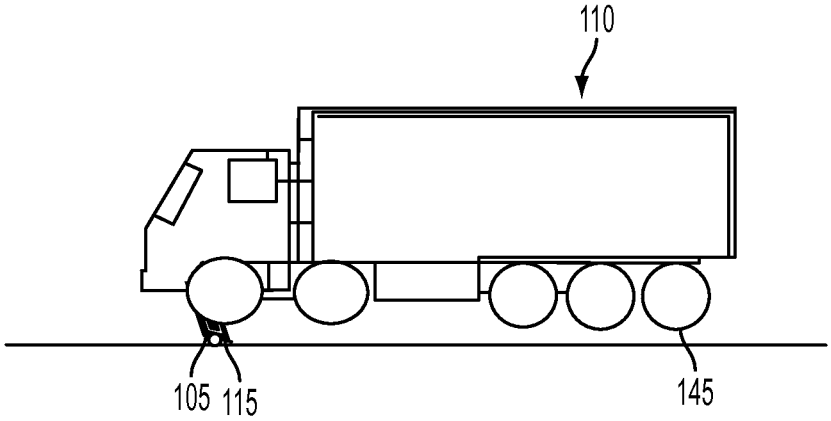
FIGS. 3-4 illustrate schematic views of a vehicle placed with respect to the vehicle wheel and axle monitoring system, in accordance with the disclosed embodiments.
Figure 4:
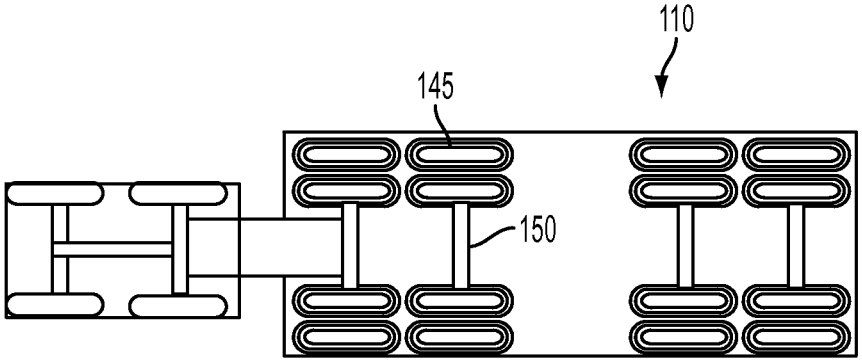

FIGS. 3-4 illustrate a schematic view of the vehicle 110 placed with respect to the strip material 105 and the detection mechanism 115, in accordance with the disclosed embodiments. The signals emitted from the detection mechanism 115 with respect to the vehicle 110 can be transmitted to the signal processing unit 140 to determine the number of wheels and axles 145 and 150 associated with the vehicle 110.

Figure 5:
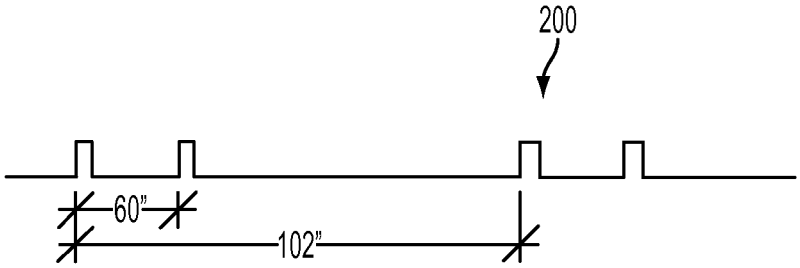
FIGS. 5-7 illustrate a graphical representation of a sensor signal pattern with respect to the detection of vehicle wheels and axles, in accordance with the disclosed embodiments.
Figure 6:
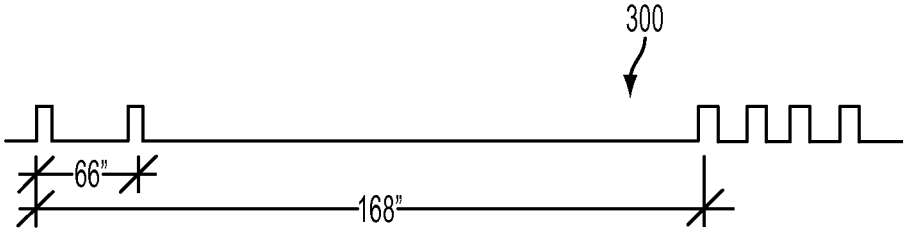
Figure 7:
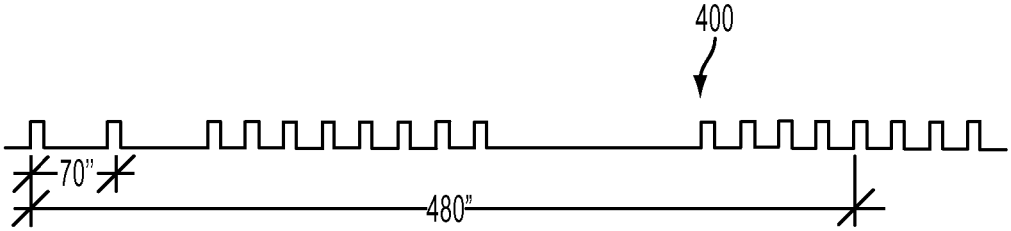

FIGS. 5-7 illustrate a graphical representation of sensor signal patterns with respect to the detection of vehicle wheel and axle 145 and 150, in accordance with the disclosed embodiments. FIG. 5, for example, illustrates a sensor signal pattern 200 with respect to a car with 102 inch wheelbase and 60 inch track. The actual timing of signals is proportional to speed. FIG. 6 depicts a sensor signal pattern 300 indicative of the example truck 110 (e.g., 6 wheeler) with 168 inch wheelbase and 66 inch track. FIG. 7 illustrates a sensor signal pattern 400 of an example tractor-trailer 110 (e.g., 18 wheeler, 35 ft dump trailer) with, for example, a 480 inch wheelbase and a 70 inch track. It can be appreciated that such factors are described herein for exemplary purposes only and are not considered limiting features of the disclosed embodiments.

Figure 8:
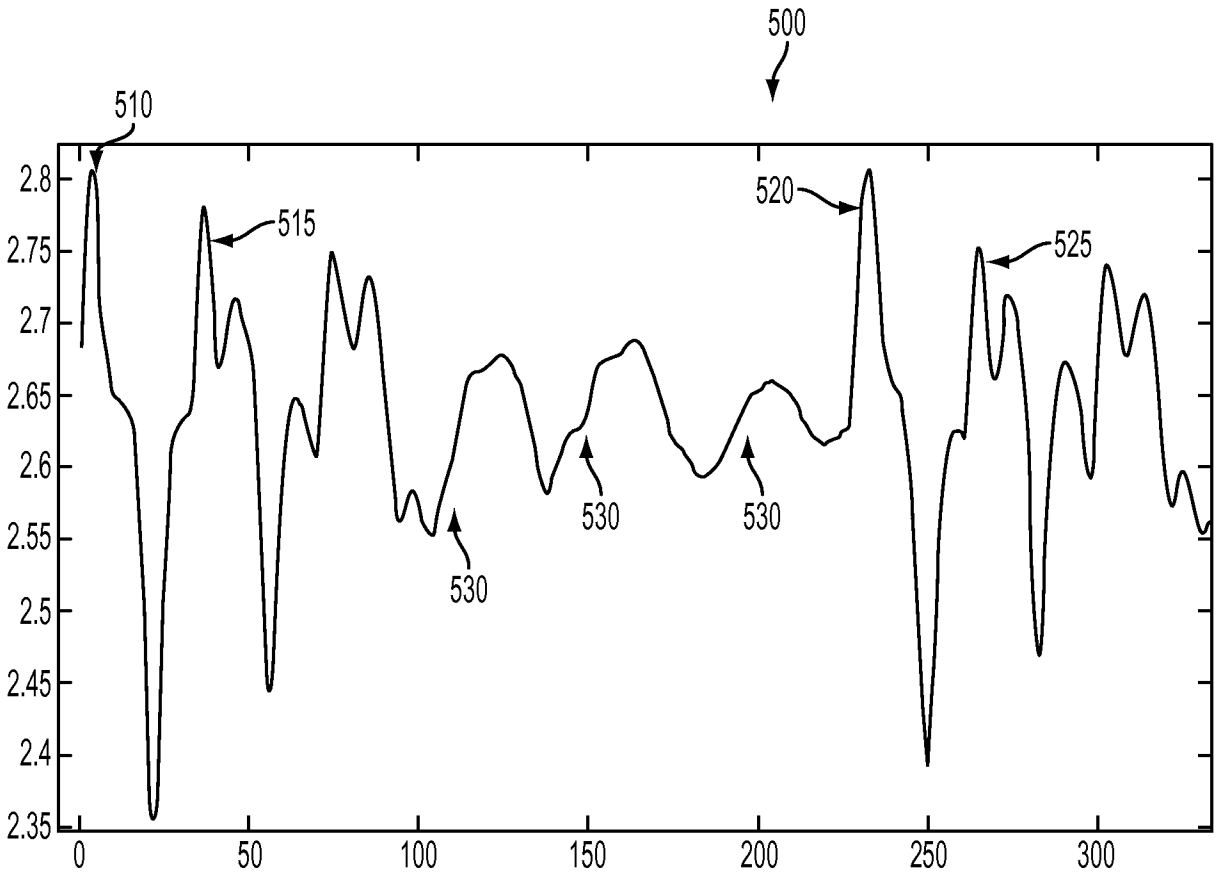
FIG. 8 illustrates a graphical representation of a response of non-optimized prototype utilizing a pressure transducer, in accordance with the disclosed embodiments.

FIG. 8 illustrates a graphical representation of a response 500 of non-optimized prototype utilizing the pressure transducer 130, in accordance with the disclosed embodiments. The graphical representation 500 illustrates a response of non-optimized prototype utilizing the pressure transducer 130 with respect to (4) wheel pickup truck. The data collected shows a right front tire 510, a left front tire 515, a right rear tire 520, a left rear tire 525, and a pneumatic system resonance 530.

Figure 9:
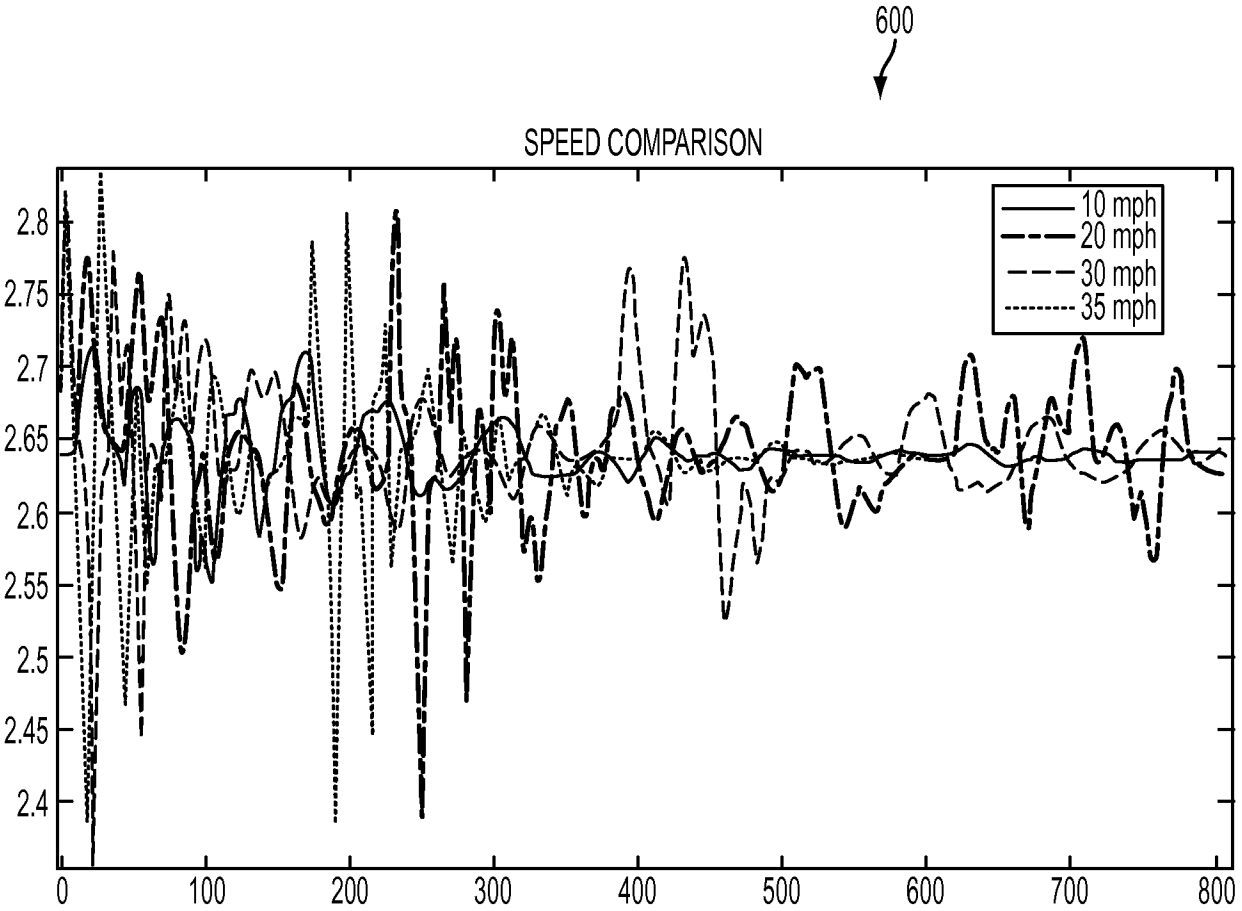
FIG. 9 illustrates a graphical representation illustrating comparison of sensor output at various speeds, in accordance with the disclosed embodiments.

FIG. 9 illustrates a graphical representation 600 of a comparison of sensor output at various speeds, in accordance with the disclosed embodiments. The sensor output with respect to the various speeds such as, for example, 10, mph 20 mph, 30 mph, and 35, mph is illustrated in FIG. 9.

Figure 10:
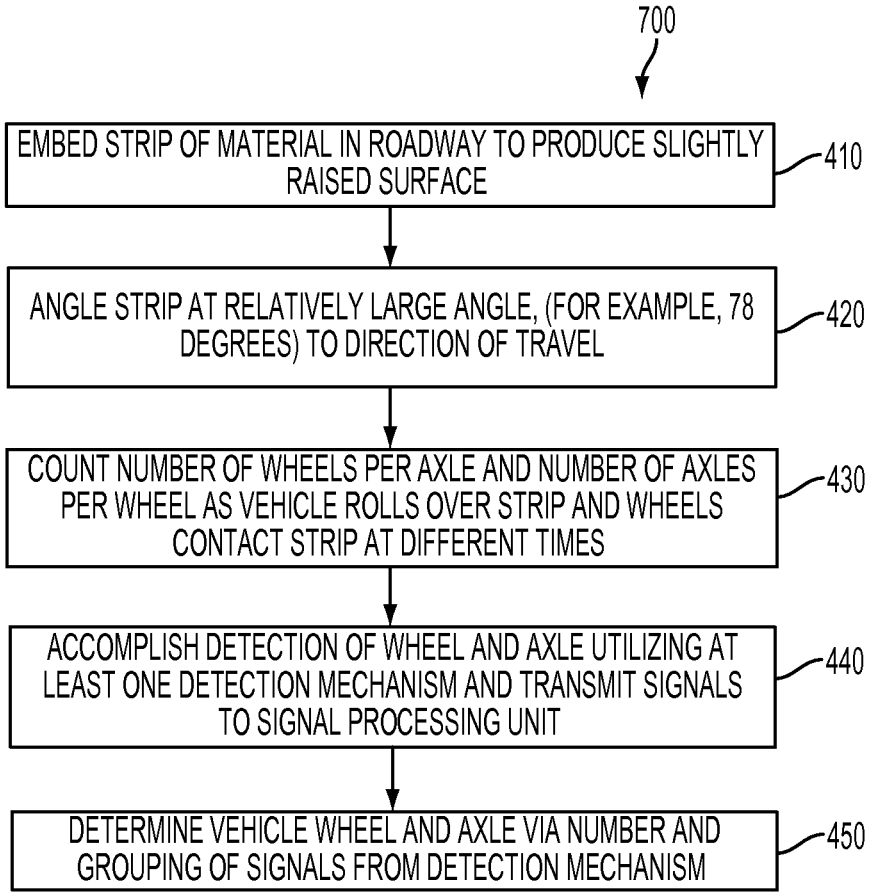
FIG. 10 illustrates a high level flow chart of operations illustrating logical operational steps of a method for monitoring vehicle wheel and axle counts, in accordance with the disclosed embodiments.

FIG. 10 illustrates a high level flow chart of operations illustrating logical operational steps of a method 700 for monitoring vehicle wheels and axles, in accordance with the disclosed embodiments. The strip material 105 can be embedded in the roadway 195 to produce the slightly raised surface, as indicated at block 410. Thereafter, the strip material 105 can be angled at a relatively large angle (e.g., 78°) to the direction of travel, as described at block 420.

The number of wheels per axle 145 and/or the number of axles per vehicle 150 can be counted as the vehicle 110 rolls over the strip material 105 and the wheels contact the strip material at different intervals, as illustrated at block 430. The detection of the wheel and axle can be accomplished utilizing one or more mechanisms 115 and the signals can be transmitted to the signal processing unit 140, as depicted at block 440. The vehicle wheel and axle 145 and 150 can be determined by the number and grouping of signals from the detection mechanism 115, as indicated at block 450.

Based on the foregoing, it can be appreciated that a technique is disclosed herein, in which strips of materials can be attached to the surface or embedded in a roadway to produce a slightly raised surface. In some embodiments, the strip can be angled at a relatively large angle to the direction of travel. It can be configured from, for example, a hosing/tubing to produce a patterned layer. As the vehicle rolls over the strip, the wheels contact the strip. Depending on the pattern, a sound wave can be generated with the surface interaction between the wheel and the strip. Collecting waves over time sound signals can be generated. These signals generally contain a pattern proportional to the number of wheels per axle and number of axles per vehicle. Two types of devices are proposed to sense the sound waves: a directional microphone on the roadside and a vibration transducer placed in close proximity to the strip. Benefits of this approach include lower cost sensing such as microphone or vibration transducers.

A number of embodiments are disclosed herein, preferred and alternative. For example, in one embodiment a method can be implemented for counting vehicle wheels and axles. Such a method can include, for example, the steps or logical operations of embedding a strip material in a roadway to produce a slightly raised surface, the strip material angled at a relatively large angle with respect to a direction of travel; counting a number of wheels per axle and a number of axles per vehicle of a vehicle as the vehicle rolls over the strip material and wheels of the vehicle contact the strip material at different intervals; and transmitting a signal emitted from one or more detection mechanisms associated with the strip material to a signal processing unit to determine the number of wheels and axles with respect to the vehicle, thereby providing a reliable, direct measurement with respect to the wheel and axle counts for a toll charge purpose.

Another embodiment may include only the steps or logical operations of counting the number of wheels per axle and a number of axles per vehicle of a vehicle as the vehicle rolls over the strip material and wheels of the vehicle contact the strip material at different intervals; and transmitting a signal emitted from the detection mechanism(s) associated with the strip material to a signal processing unit to determine the number of wheels and axles with respect to the vehicle, thereby providing a reliable, direct measurement with respect to the wheel and axle counts for a toll charge purpose.

In another embodiment, a step or logical operation can be implemented for attaching the strip material to the roadway; and detecting contact between tires with respect to the vehicle and the strip material via the detection mechanism, the detection mechanism comprising a microphone that detects sound with respect to the tires hitting or contacting the strip material. In some embodiments, the microphone may be a directional type microphone located at or proximate to the roadside. In still another embodiment, the detection mechanism may be or can include a vibration transducer placed in a pavement in close proximity to the strip material to assist in detecting the wheel and axle.

In another embodiment, the detection mechanism may be or may include a pressure transducer attached to a tube if the strip material is configured from a hose or tubing. In some embodiments the tires contacting the tube can result in an increase in a pressure and a fluctuation similar to an audible signal. A step or logical operation can then be implemented for estimating the gross weight of the vehicle based on a magnitude of the fluctuation in the pressure. In still another embodiment, the aforementioned strip material can be angled, for example, at least 78 degrees with respect to the direction of travel.

In another embodiment, a system for counting vehicle wheels and axles can be implemented. Such a system may include, for example, a strip material embedded in a roadway to produce a slightly raised surface thereof, the strip material angled at a relatively large angle with respect to a direction of travel; a counter for counting a number of wheels per axle and a number of axles per vehicle of a vehicle as the vehicle rolls over the strip material and wheels of the vehicle contact the strip material at different intervals; and a transmitter for transmitting a signal emitted from the detection mechanism(s) associated with the strip material to a signal processing unit to determine the number of wheels and axles with respect to the vehicle, thereby providing a reliable, direct measurement with respect to the wheel and axle count for a toll charge purpose.

In some system embodiments, the strip material may be attached to the roadway. In another system embodiment, contact between tires with respect to the vehicle and the strip material is detectable via the detection mechanism, and the detection mechanism may be or can include a microphone that detects sound with respect to the tires hitting or contacting the strip material. In another system embodiment, the microphone can be a directional-type microphone located at or proximate to the roadside. In yet another system embodiment, the detection mechanism can include or may be a vibration transducer placed in the pavement in close proximity to the strip material to assist in detecting the wheel and axle. In still another system embodiment, the detection mechanism may be or can include a pressure transducer such that the tires contacting the tube results in an increase in pressure and/or fluctuation similar to an audible signal. In another system embodiment, an estimation module (e.g., a software module and/or a hardware module) can be provided for estimating the gross weight of the vehicle based on a magnitude of the fluctuation in the pressure. Additionally, in some system embodiments the strip material can be angled at least 78 degrees with respect to the direction of travel.

It can be appreciated that certain aspects of the disclosed embodiments can be implemented in the context of a method or a system, or a data-processing system and/or a computer program product. Accordingly, some embodiments may take the form of an entire hardware implementation, an entire software implementation or in all likelihood, an embodiment combining software and hardware aspects all generally referred to herein as a "circuit" or "module." Furthermore, the embodiments may take the form of a computer program product on a computer-usable storage medium having computer-usable program code embodied in the medium. Any suitable computer readable medium may be utilized including hard disks, USB flash drives, DVDs, CD-ROMs, optical storage devices, magnetic storage devices, etc.

Note that at least some aspects of the embodiments can be implemented in the general context of computer-executable instructions such as program modules being executed by a single computer. In most instances, a "module" constitutes a software application. Generally, program modules can include, but are not limited to, routines, subroutines, software applications, programs, objects, components, data structures, etc., that perform particular tasks or implement particular abstract data types and instructions. Moreover, those skilled in the art will appreciate that the disclosed method and system may be practiced with other computer system configurations such as, for example, hand-held devices, multi-processor systems, data networks, microprocessor-based or programmable consumer electronics, networked personal computers, mini-computers, mainframe computers, servers, and the like.

Thus, for example, the aforementioned counter can be implemented as a module for counting a number of wheels per axle and a number of axles per vehicle of a vehicle as the vehicle rolls over the strip material and wheels of the vehicle contact the strip material at different intervals, and the aforementioned transmitter can be implemented in some embodiments as a module (e.g., software and hardware) for transmitting a signal emitted from the detection mechanism(s) associated with the strip material to a signal processing unit to determine the number of wheels and axles with respect to the vehicle, thereby providing a reliable, direct measurement with respect to the wheel and axle count for a toll charge purpose. Similarly, an estimation module can be provided for estimating a gross weight of the vehicle based on the magnitude of the fluctuation in the pressure.

A number of embodiments are thus disclosed herein. In one embodiment, for example, a method for counting vehicle wheels and axles can be implemented. Such a method can include the steps or logical operations of, for example, embedding a strip material in a roadway to produce a slightly raised surface, the strip material angled at a relatively large angle with respect to a direction of travel; counting the number of wheels per axle and a number of axles per vehicle of a vehicle as the vehicle rolls over the strip material and wheels of the vehicle contact the strip material at different intervals; and transmitting a signal emitted from one or more detection mechanisms associated with the strip material to a signal processing unit to determine the number of wheels and axles with respect to the vehicle, thereby providing a reliable, direct measurement with respect to the wheel and axle count for a toll charge purpose.

In another embodiment, the strip material may be attached to the roadway. In yet another embodiment, a step or logical operation can be provided for detecting contact between tires with respect to the vehicle and the strip material via the detection mechanism(s), the detection mechanism(s) comprising a microphone that detects sound with respect to the tires hitting or contacting the strip material. In some embodiments, the microphone can be a directional type microphone located at or proximate to the roadside. In another embodiment, the detection mechanism may be a vibration transducer placed in a pavement in close proximity to the strip material to assist in detecting the wheel and axle. In still another embodiment, the detection mechanism can be a pressure transducer attached to a tube if, for example, the strip material is configured from a hose or tubing.

In another embodiment, the tires contacting the tube can result in an increase in pressure and fluctuation similar to, for example, an audible signal. In yet another embodiment, a step or logical operation can be provided for estimating the gross weight of the vehicle based on a magnitude of the fluctuation in the pressure. In another embodiment, a step or logical operation can be provided for configuring the strip material to be angled at least 78 degrees with respect to the direction of travel.

In another embodiment, a system can be provided for counting vehicle wheels and axles. Such a system can include, for example, a strip material embedded in a roadway to produce a slightly raised surface thereof, the strip material angled at a relatively large angle with respect to a direction of travel; a counter for counting a number of wheels per axle and a number of axles per vehicle of a vehicle as the vehicle rolls over the strip material and wheels of the vehicle contact the strip material at different intervals; and a transmitter for transmitting a signal emitted from one or more detection mechanisms associated with the strip material to a signal processing unit to determine the number of wheels and axles with respect to the vehicle, thereby providing a reliable, direct measurement with respect to the wheel and axle count for a toll charge purpose.

In still another embodiment, a system for counting vehicle wheels and axles can be implemented. Such a system can include, for example, a strip material embedded in and/or attached to a roadway to produce a slightly raised surface thereof, the strip material angled at a relatively large angle with respect to a direction of travel; a counter for counting a number of wheels per axle and a number of axles per vehicle of a vehicle as the vehicle rolls over the strip material and wheels of the vehicle contact the strip material at different intervals; a transmitter for transmitting a signal emitted from one or more mechanisms associated with the strip material to a signal processing unit to determine the number of wheels and axles with respect to the vehicle, thereby providing a reliable, direct measurement with respect to the wheel and axle count for a toll charge purpose; a pressure transducer such that the tires contacting the tube results in an increase in a pressure and a fluctuation similar to an audible signal; and an estimation module for estimating a gross weight of the vehicle based on a magnitude of the fluctuation in the pressure.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A method for counting vehicle wheels and axles, said method comprising:

embedding a strip material in a roadway to produce a slightly raised surface, said strip material angled at a relatively large angle with respect to a direction of travel;

counting a number of wheels per axle and a number of axles per vehicle of a vehicle as said vehicle rolls over said strip material and wheels of said vehicle contact said strip material at different intervals; and transmitting a signal emitted from at least one detection mechanism associated with said strip material to a signal processing unit to determine said number of wheels and axles with respect to said vehicle, thereby providing a reliable, direct measurement with respect to said wheel and axle count for a toll charge purpose.

2. The method of claim 1 further comprising attaching said strip material to said roadway.

3. The method of claim 1 further comprising detecting contact between tires with respect to said vehicle and said strip material via said at least one detection mechanism, said at least one detection mechanism comprising a microphone that detects sound with respect to said tires hitting or contacting said strip material.

4. The method of claim 3 wherein said microphone comprises a directional type microphone located at or proximate to said roadside.

5. The method of claim 1 wherein said at least one detection mechanism further comprising a vibration transducer placed in a pavement in close proximity to said strip material to assist in detecting said wheel and axle.

6. The method of claim 1 wherein said at least one detection mechanism further comprises a pressure transducer attached to a tube if said strip material is configured from a hose or tubing.

7. The method of claim 6 wherein said tires contacting said tube results in an increase in a pressure and a fluctuation similar to an audible signal.

8. The method of claim 7 further comprising estimating a gross weight of said vehicle based on a magnitude of said fluctuation in said pressure.

9. The method of claim 1 further comprising configuring said strip material to be angled at least 78 degrees with respect to said direction of travel.

10. A system for counting vehicle wheels and axles, said system comprising:

a strip material embedded in a roadway to produce a slightly raised surface thereof, said strip material angled at a relatively large angle with respect to a direction of travel;

a counter for counting a number of wheels per axle and a number of axles per vehicle of a vehicle as said vehicle rolls over said strip material and wheels of said vehicle contact said strip material at different intervals; and a transmitter for transmitting a signal emitted from at least one detection mechanism associated with said strip material to a signal processing unit to determine said number of wheels and axles with respect to said vehicle, thereby providing a reliable, direct measurement with respect to said wheel and axle count for a toll charge purpose.

11. The system of claim 10 wherein said strip material is attached to said roadway.

12. The system of claim 10 wherein:

contact between tires with respect to said vehicle and said strip material is detectable via said at least one detection mechanism; and said at least one detection mechanism comprises a microphone that detects sound with respect to said tires hitting or contacting said strip material.

13. The system of claim 12 wherein said microphone comprises a directional-type microphone located at or proximate to said roadside.

14. The system of claim 10 wherein said at least one detection mechanism further comprises a vibration transducer placed in a pavement in close proximity to said strip material to assist in detecting said wheel and axle.

15. The system of claim 10 wherein said at least one detection mechanism further comprises a pressure transducer such that said tires contacting said tube results in an increase in a pressure and a fluctuation similar to an audible signal.

16. The system of claim 15 further comprising an estimation module for estimating a gross weight of said vehicle based on a magnitude of said fluctuation in said pressure.

17. The system of claim 10 wherein said strip material is angled at least 78 degrees with respect to said direction of travel.

18. A system for counting vehicle wheels and axles, said system comprising:

a strip material embedded in and/or attached to a roadway to produce a slightly raised surface thereof, said strip material angled at a relatively large angle with respect to a direction of travel;

a counter for counting a number of wheels per axle and a number of axles per vehicle of a vehicle as said vehicle rolls over said strip material and wheels of said vehicle contact said strip material at different intervals;

a transmitter for transmitting a signal emitted from at least one detection mechanism associated with said strip material to a signal processing unit to determine said number of wheels and axles with respect to said vehicle, thereby providing a reliable, direct measurement with respect to said wheel and axle count for a toll charge purpose;

a pressure transducer such that said tires contacting said tube results in an increase in a pressure and a fluctuation similar to an audible signal; and an estimation module for estimating a gross weight of said vehicle based on a magnitude of said fluctuation in said pressure.

19. The system of claim 18 wherein said microphone comprises a directional-type microphone located at or proximate to said roadside.

20. The system of claim 17 wherein said at least one detection mechanism further comprises a vibration transducer placed in a pavement in close proximity to said strip material to assist in detecting said wheel and axle.

* * * * *